US012281884B2

(12) United States Patent
Hurt et al.

(10) Patent No.: US 12,281,884 B2
(45) Date of Patent: Apr. 22, 2025

(54) BULLET WITH JACKET IMPROVEMENTS

(71) Applicant: Federal Cartridge Company, Anoka, MN (US)

(72) Inventors: Richard Hurt, Clear Lake, MN (US); Lawrence P. Head, Cambridge, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 17/884,502

(22) Filed: Aug. 9, 2022

(65) Prior Publication Data

US 2023/0045740 A1 Feb. 9, 2023

Related U.S. Application Data

(60) Provisional application No. 63/231,205, filed on Aug. 9, 2021.

(51) Int. Cl.

| | |
|---|---|
| ***F42B 12/78*** | (2006.01) |
| ***F42B 12/34*** | (2006.01) |
| ***F42B 30/02*** | (2006.01) |
| ***F42B 33/00*** | (2006.01) |

(52) U.S. Cl.

CPC ..... *F42B 12/78* (2013.01); *F42B 33/001* (2013.01); *F42B 12/34* (2013.01); *F42B 30/02* (2013.01)

(58) Field of Classification Search

CPC ..... F42B 12/34; F42B 12/78; F42B 33/00; F42B 33/001; F42B 30/02

USPC ..... 102/506–509, 514

See application file for complete search history.

(56) References Cited

U.S. PATENT DOCUMENTS

| | | | | |
|---|---|---|---|---|
| 3,143,966 | A | 8/1964 | Burns et al. | |
| 3,756,158 | A | 9/1973 | Anderson | |
| 4,879,953 | A | 11/1989 | Carter | |
| 5,404,815 | A | 4/1995 | Reed | |
| 7,980,180 | B2 | 7/2011 | MacDougall | |
| 8,256,352 | B2 * | 9/2012 | Masinelli | F42B 12/34 102/514 |
| 8,646,389 | B2 | 2/2014 | Masinelli | |
| 8,752,484 | B2 | 6/2014 | Burczynski | |
| 9,046,333 | B2 * | 6/2015 | Masinelli | F42B 12/78 |
| 9,207,052 | B2 | 12/2015 | Burczynski | |
| 9,366,512 | B2 * | 6/2016 | Burczynski | F42B 30/02 |
| 9,500,455 | B2 * | 11/2016 | Riess | F42B 12/78 |
| 9,863,746 | B2 | 1/2018 | Peterson | |
| 9,885,552 | B2 * | 2/2018 | Krause | F42B 33/00 |
| 10,690,464 | B2 * | 6/2020 | Peterson | F42B 12/367 |

(Continued)

FOREIGN PATENT DOCUMENTS

| | | |
|---|---|---|
| EP | 0225532 A1 | 11/1986 |
| WO | 9720185 A1 | 6/1997 |
| WO | 0120245 A1 | 3/2001 |

OTHER PUBLICATIONS

International Search Report and Written Opinion dated Nov. 3, 2022 for PCT/US22/39880.

*Primary Examiner* — James S Bergin

(74) *Attorney, Agent, or Firm* — Christensen, Fonder, Dardi & Herbert, PLLC; Timothy J. Busse

(57) ABSTRACT

Devices and methods for a bullet with a strengthened mouth for improved penetration and expansion. In embodiments, a portion of the jacket is folded to provide double walls at the mouth. In embodiments, the jacket and core are partially bonded and partially separated.

21 Claims, 16 Drawing Sheets

(56) References Cited

U.S. PATENT DOCUMENTS

| | | | | |
|---|---|---|---|---|
| 11,268,791 | B1 * | 3/2022 | Frees | F42B 12/02 |
| 2005/0126422 | A1 | 6/2005 | Lamm | |
| 2010/0018430 | A1 * | 1/2010 | Masinelli | F42B 30/02<br>102/516 |
| 2016/0209192 | A1 * | 7/2016 | Masinelli | F42B 12/74 |
| 2017/0052008 | A1 | 2/2017 | Peterson | |

* cited by examiner

Standard HST

Folded Mouth HST

Standard HS Deep

Folded Mouth HS Deep

Folded Mouth HS Deep w/ elastomer

BULLET WITH JACKET IMPROVEMENTS

This application claims the benefit of U.S. Provisional Application No. 63/231,205, filed Aug. 9, 2021, the disclosure of which is incorporated by reference herein.

FIELD OF THE INVENTION

The present invention is directed to bullet modifications for improving strength along with penetration and expansion performance.

BACKGROUND OF THE INVENTION

A bullet is subjected to significant front forces on impact and, in some applications, may have to penetrate an intermediate material (e.g., window glass, metal, or wood) before reaching a target and subsequently expanding.

SUMMARY OF THE INVENTION

A feature and benefit of embodiments is a bullet for penetration and expansion upon impact, the bullet defining a central axis comprising a forward direction and a rearward direction, the bullet comprising a core, a soft point, and a jacket. The core comprises an outer circumferential surface, the core comprising: a rearward portion, a forward portion, the forward portion defining a cavity forming a hollow point of the bullet, the cavity comprising a radially inward surface, and a tip portion forward of the forward ogive portion, the tip portion transitioning from the outer circumferential surface to the radially inward surface. The soft point fills the cavity. The jacket extends along the outer circumferential surface, the jacket comprising: a midline extending longitudinally at the middle of the radial thickness of the jacket to an endpoint where the radial thickness changes substantially or the jacket terminates, a rearward cup portion, an ogive portion, an end portion, and a plurality of skives. The ogive portion is forward of the rearward cup portion. The end portion is directly adjacent the tip portion of the core, the end portion of the jacket curling radially inwardly toward the central axis. The plurality of skives are formed in the ogive portion of the jacket. The midline of the jacket defines the inward curl of the end portion by rotating radially inward from a departure orientation at a starting point of the end portion to a terminal orientation at an endpoint of the end portion, the terminal orientation being arranged at a curl angle $\omega$ of at least about 0 degrees measured radially inwardly relative to the central axis.

In embodiments, the curl angle $\omega$ is between about 0 and about 45 degrees.

In embodiments, the curl angle $\omega$ is between about 0 and about 90 degrees.

In embodiments, the midline of the jacket rotates from a starting point of the inward curl of the end portion to the ending point by an angle $\delta$ of at least 135 degrees.

In embodiments, the midline of the jacket extends in a curl direction at the endpoint of the end portion, the curl direction being substantially rearward or rearward and radially outward.

In embodiments, the plurality of skives extend at least partially through the curled end portion.

In embodiments, a shear groove is formed in the jacket, the shear groove configured to prevent overexpansion of petals formed upon impact.

In embodiments, the end portion of the jacket partially defines the cavity.

In embodiments, the deformable material is positioned inside the end portion of the jacket.

In embodiments, the ogive portion of the jacket comprises a radially inner surface, wherein a portion of the core is positioned along the radially inner surface between a proximal portion and a distal portion of the end portion of the jacket.

In embodiments, the jacket comprises a double walled region of the jacket, wherein the ogive portion of the jacket is not double walled.

In embodiments, the jacket does not fully enclose the core.

In embodiments, the jacket and core are partially bonded.

In embodiments, the jacket and core are only bonded rearward of the skives.

In embodiments, the jacket further comprises at least one circumferential cannelure formed in the jacket.

A feature and benefit of embodiments is a method of manufacturing a hollowpoint bullet, comprising: providing a jacket with an open forward end; inserting a core into the jacket; partially bonding the jacket and the core with an unbonded region forward of a bonded region; curling the open forward end of the jacket radially inwardly to form a double walled region of the jacket; forming a forward-facing cavity in the core; and forming an ogive shape in a forward portion of the bullet.

In embodiments, the partially bonding step comprises separating the jacket from the core from the forward end to a depth, wherein the depth is not an entire length of the core.

In embodiments, the separating is performed by a punch.

In embodiments, the partially bonding step comprises: applying a barrier to one or more of a forward portion of the core and a forward portion of the jacket, the barrier not applied to rearward portions of the jacket or core, and bonding rearward portions of the jacket and core.

In embodiments, the unbonded region extends to a depth measured from the rear of the bullet, the depth being about 50%-75% of an overall length of the bullet.

In embodiments, the method further comprises at least one of: forming a skive in the jacket extending approximately to the depth, and forming a shear groove in the jacket approximately at the depth.

A feature and benefit of embodiments is a method of manufacturing a partially-bonded bullet, comprising: providing a jacket with an open forward end; inserting a core in the jacket; and partially bonding the jacket and the core rearward of a predetermined depth, wherein the depth is not an entire length of the core.

A feature and benefit of embodiments is a bullet for penetration and expansion upon impact, the bullet defining a central axis comprising a forward direction and a rearward direction, the bullet comprising a core, a deformable material, and a jacket. The core comprises an outer circumferential surface, a rearward portion, a forward portion, the forward portion defining a cavity forming a hollow point of the bullet, the cavity comprising a radially inward surface, and a tip portion forward of the forward portion, the tip portion transitioning from the outer circumferential surface to the radially inward surface. The deformable material fills the cavity. The jacket extends along the outer circumferential surface of the core and comprises: a rearward cup portion, an ogive portion forward of the rearward cup portion, an end portion of the jacket curling radially inwardly toward the central axis, the end portion comprising a terminal face. A plurality of skives are formed in the ogive portion of the jacket. The terminal face is oriented at an angle α of at least 90 degrees measured radially inward from the forward direction of the central axis.

A feature and benefit of embodiments is a bullet for penetration and expansion upon impact, the bullet defining a central axis comprising a forward direction and a rearward direction, the bullet comprising a core, a soft point, and a jacket. The core comprises an outer circumferential surface, a rearward portion, a forward portion, the forward portion defining a cavity forming a hollow point of the bullet, the cavity comprising a radially inward surface, and a tip portion forward of the forward ogive portion, the tip portion transitioning from the outer circumferential surface to the radially inward surface. The soft point fills the cavity. The jacket extends along the outer circumferential surface of the core, and comprises: a midline extending longitudinally at the middle of the radial thickness of the jacket to an endpoint where jacket terminates or the radial thickness changes substantially, a rearward cup portion, an ogive portion forward of the rearward cup portion and comprising a radially inner surface, the ogive portion comprising a terminal angle defined by a terminal tangent of the outer circumferential surface relative to the central axis, and a double-walled end portion. The double-walled end portion is directly adjacent the tip portion of the core, the end portion of the jacket formed by curling radially inwardly toward the central axis. A plurality of skives are formed in the ogive portion of the jacket. The midline of the jacket in the end portion rotates by a curl angle ω from the central axis to the ending point, the curl angle ω being at least 0 degrees.

A feature and benefit of embodiments is a bullet for penetration and expansion upon impact, the bullet defining a central axis comprising a forward direction and a rearward direction, the bullet comprising a core, a soft point, and a jacket. The core comprises an outer circumferential surface, a rearward portion, a forward portion, and a tip portion. The forward portion defines a cavity forming a hollow point of the bullet, the cavity comprising a radially inward surface. The tip portion is forward of the forward portion, the tip portion transitioning from the outer circumferential surface to the radially inward surface. The soft point fills the cavity. The jacket extends along the outer circumferential surface and comprises: a rearward cup portion, a double-walled region directly adjacent the tip portion of the core, the double-walled region formed by an end portion of the jacket curling radially inwardly from a starting point toward the central axis, an ogive portion forward of the rearward cup portion and extending to the starting point of the end portion, the ogive portion comprising a radially inner surface and an angle β relative to the central axis defined by a departure tangent of the inner circumferential surface at the starting point. A plurality of skives are formed in the ogive portion of the jacket. An inner surface of the end portion curls inwardly to define a curl tangent of the inner surface at a terminus of the jacket, the curl tangent being oriented at a curl angle ω of at least 0 degrees radially inward from the central axis.

The summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
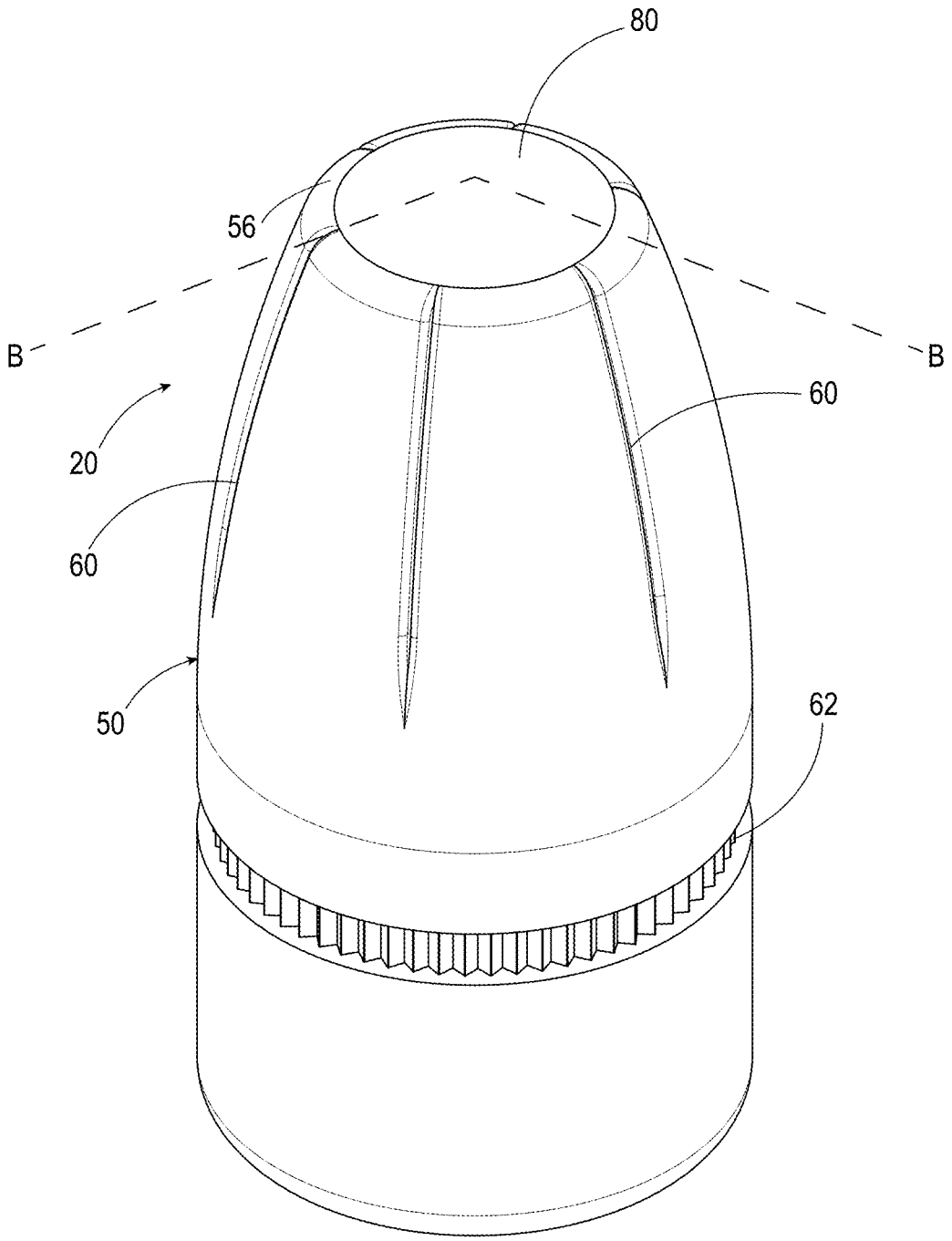
FIG. 1 is a top perspective view of an example bullet in accord with embodiments of the present disclosure.
Figure 2:
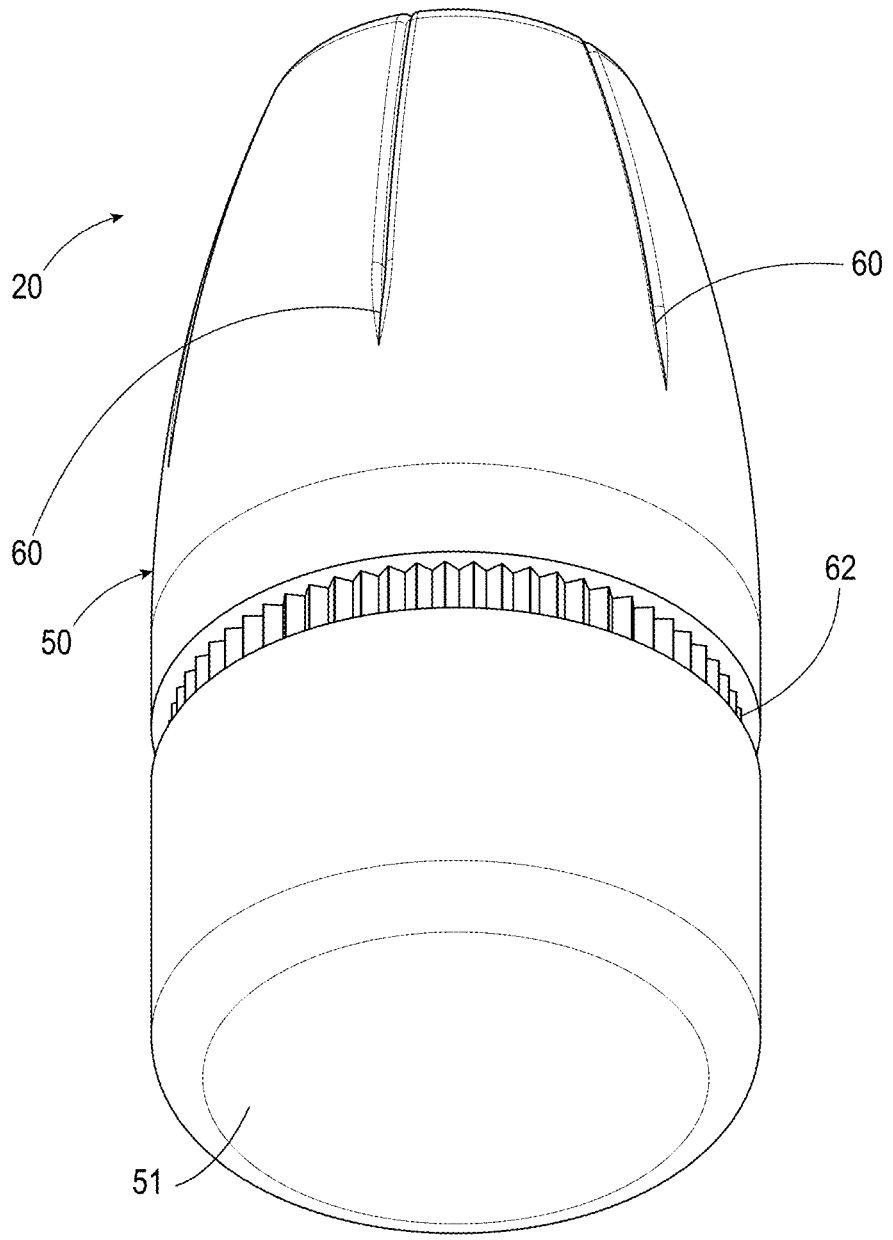
FIG. 2 is a bottom perspective view of the bullet in FIG. 1.
Figure 4:
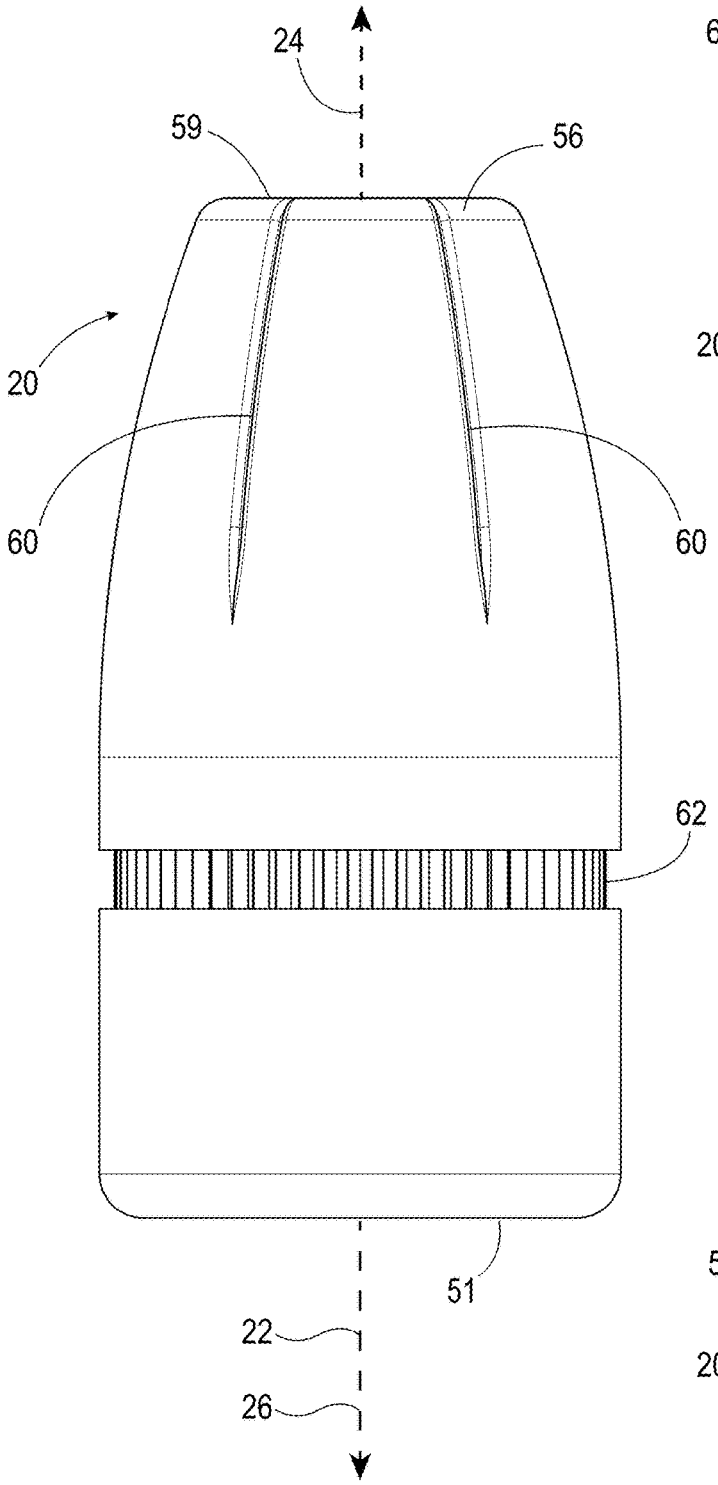
FIG. 4 is a bottom view of the bullet in FIG. 1.
Figure 3:
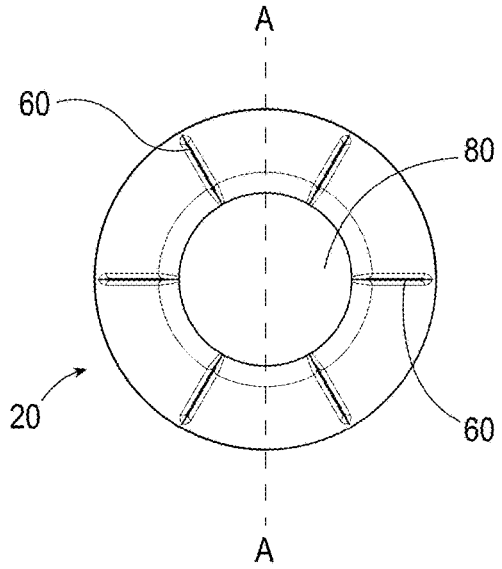
FIG. 3 is a top view of the bullet in FIG. 1.
Figure 5:
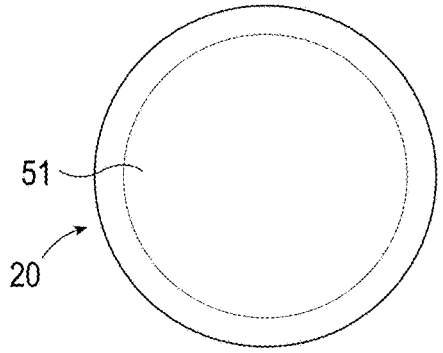
FIG. 5 is a side elevation view of the bullet in FIG. 1.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As shown in FIGS. 1-5, one embodiment of a bullet 20 of the present invention is shown. The bullet comprises and defines a central axis 22 defining a forward direction 24 and a rearward direction 26. In some embodiments, the bullet 20 further comprises a core 30 and a jacket 50. In other embodiments, the bullet includes a deformable material 80 at a forward end of the bullet forming a soft point. In embodiments, the core 30 and the jacket 50 are either bonded together along the entire interface of the core and jacket or are partially bonded only along a portion of the interface.

The core 30 comprises an outer circumferential surface 32, a rearward portion 34, and a forward portion 36. In some embodiments, the forward portion 36 defines a cavity 38 forming a hollow point of the bullet, the cavity comprising a radially inward surface 40. In some embodiments, the core also comprises a tip portion 42 forward of the forward portion 36, the tip portion transitioning from the outer circumferential surface 32 to the radially inward surface 40. In embodiments, the jacket 50 does not extend over the entire radially inward surface 40 and the core 30 is therefore not fully enclosed by the jacket.

In some embodiments, a deformable material 80 fills the cavity 38 of the core 30. The deformable material 80 in embodiments may be an elastomer such as silicone or a thermoplastic elastomer. By occupying the space within the cavity 38, the deformable material 80 may improve terminal performance in impact and penetration through barriers by preventing plugging (i.e. debris, e.g., a piece of a plywood barrier getting caught in the cavity) while still promoting expansion and petaling in a softer target (e.g., ballistic gel). In certain embodiments, the deformable material 80 is one or more of a UV-cured silicone, silicone rubber, and silicone sealant. In other embodiments, the deformable material 80 may be another deformable material, such as rubber, wax, putty, combinations of two or more of the disclosed materials, and the like. The deformable material 80 may be any of the materials disclosed in U.S. Pat. No. 10,041,773, the disclosure of which is incorporated herein in its entirety and for all purposes, or may be any other material known by one of ordinary skill in the art for filling the cavity of a hollow point bullet. Embodiments of the deformable material 80 may be a polymer formed of various known thermoplastic elastomers or other polymers such as polyamides, acrylonitrile butadiene styrene (ABS), polyetheretherketone (PEEK), polyetherketone (PEK), polyethylene terephthalate (PET), polyoxymethylene plastic (POM/Acetal), ultra-high-molecular-weight poly-ethylene (UHMWPE/UHMW), various fluoropolymers such as polytetrafluoroethylene (PTFE). In various embodiments, the deformable material 80 is a polymer formed via an insert-molding process where a thermoplastic is injected into the cavity 38. In some embodiments, the deformable material 80 is retained in place in part due to adhesion between the core 30 and the deformable material 80 as a result of the insert molding and solidifying process.

In certain embodiments, the bullet 20 further comprises a jacket 50 extending along the outer circumferential surface 32 of the core 30, the jacket comprising: a rear end 51, a rearward cup portion 52, a mid portion 53, and an ogive portion 54 forward of the mid portion and having a decreasing diameter in the forward direction. In embodiments, one or both of the rearward cup portion 52 and the mid portion 53 may be substantially cylindrical and sized to engage a firearm barrel upon firing. In embodiments, one or both of the rearward cup portion 52 and the mid portion 53 may have a boat tail shape with decreasing diameter in the rearward direction 26.

Referring also to FIGS. 6-12, in embodiments, the jacket 50 further comprises an end portion 56 curling radially inwardly toward the central axis 22 and defining a forward-facing mouth of the bullet 20. The end portion 56 of the jacket is directly adjacent the tip portion 42 of the core 30. In some embodiments, the end portion 56 comprises a terminal face 58 at its distal terminus after the curl. The end portion defines a forward tip 59 of the jacket 50 and the bullet 20. In embodiments, the end portion 56 is the portion of the jacket 50 that departs from the curvature of the ogive portion 54 to curl toward the central axis 22.

In some embodiments of the curled end portion 56 of the jacket 50, the jacket further comprises a double walled region 57 having a distal portion 57B and a proximal portion 57A that overlap in the radial direction. In some embodiments, the distal portion 57B has a length extending rearward beyond the proximal portion 57A to also overlap the ogive portion 54. It will be appreciated that each of the curled end portion 56 and double walled region 57 provide an overall radial thickness of jacket material that is greater than the thickness of the jacket 50 along the remainder of the ogive portion 54 and the mid portion 53. As a result, the jacket 50 of the bullet 20 may have greater strength in the mouth than conventional bullets of the same materials. Although the end portion 56 is illustrated as folded radially inward, in some embodiments the end portion of the jacket 50 may be folded radially outward to provide similar benefits.

Variations are contemplated for the relative arrangement of the cavity 38, the end portion 56 of the jacket 50, and the inward surface 40 of the core 30. In embodiments, the end portion 56 of the jacket 50 partially defines the cavity 38. In some embodiments, the deformable material 80 is positioned inside the end portion 56 of the jacket 50. In embodiments, the ogive portion 54 of the jacket 50 comprises a radially inner surface 64, wherein a portion of the core 30 is positioned between the radially inner surface and the end portion 56 of the jacket (see, e.g., FIG. 11). In certain embodiments, a portion of the core 30 extends inside the double walled region 57, i.e., between the proximal portion 57A and the distal portion 57B.

In certain embodiments, the jacket 50 comprises a plurality of skives 60 or other such weakening structure to encourage petaling or tearing upon impact, the skives 60 formed in the ogive portion 54. In embodiments, the skives 60 extend forward through the end portion 56 to the forward tip 59. In certain embodiments, the skives 60 extend through the entire end portion 56 including the distal portion 57B. In some embodiments, the skives 60 extend rearward to the mid portion 53. In some embodiments, the jacket comprises at least one circumferential cannelure 62 formed in the mid portion 53 and/or the rearward cup portion 52.

Figure 12:
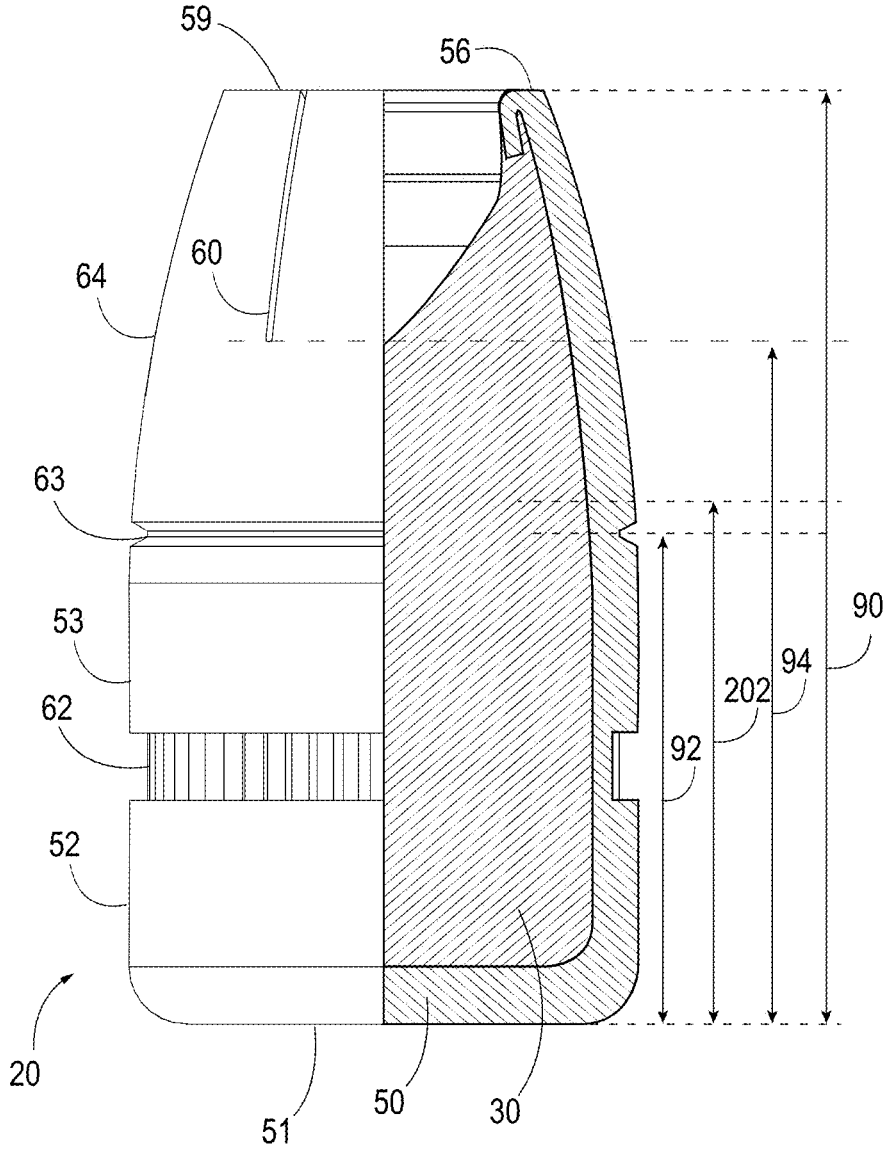
FIG. 12 is a side elevation view of another example bullet in accord with embodiments of the present disclosure with a portion removed along the line B-B in FIG. 1.

As shown in FIG. 12, in certain embodiments, the jacket 50 comprises a shear groove 63 or forward cannelure formed in the mid portion 53 or the ogive portion 54 and positioned in front of the rearward cannelure 62. The shear groove 63 may be a shear groove as disclosed in U.S. Pat. No. 11,268,791, the contents of which are incorporated herein in their entirety and for all purposes. The shear groove 63 in embodiments is located rearward of the skives 60 and functions to cause petals of the jacket to separate at the shear groove instead of tearing further rearward and over-expanding. In embodiments, one or both of the cannelure 62 and the shear groove 63 may be an indentation formed only in the jacket 50 or substantially only in the jacket. In other embodiments, one or both of the cannelure 62 and the shear groove 63 may be an indentation formed in both the jacket 50 and the core 30.

Further functions and benefits of the skives 60 and/or cannelure 62, 63 along with other details of a bullet 20 are disclosed in U.S. Pat. Nos. 9,863,746 and 10,690,464, the disclosures of which are incorporated herein in their entirety and for all purposes. In embodiments, the skives 60 extend axially in the ogive portion 54 of the jacket 50. In embodiments, the skives 60 will terminate at a point before where the bullet 20 will engage barrel rifling and/or before the cylindrical rear portion 52 of the bullet. The skives 60 may be in various forms including scores, cuts extending partially or completely through the thickness of the jacket 50, folds in the jacket, indentations in the jacket, or other weakening of the jacket axially to facilitate tearing and opening of the jacket.

In some embodiments, the end portion 56 of the jacket 50 comprises a terminal face 58 at its distal terminus after the inward curl of the end portion. The end portion 56 of the jacket is directly adjacent the tip portion 42 of the core 30, the end portion being the portion of the jacket that departs from the ogive curvature and curls inwardly toward the central axis 22. Due to the curled shape of the end portion 56, the terminal face 58 is oriented at a terminal face angle α measured inwardly (as indicated in FIGS. 7, 11, 11B, and 11C) from a reference axis 28 that is parallel to the central axis 22 and located radially outward from the end portion 56, e.g., extending along the exterior surface of the jacket 50.

The terminal face 58 is directed in a curl direction 79. In embodiments, the curl direction 79 is one of substantially the rearward direction 26 (as in FIGS. 6-7) or directed rearward and angled inward toward the central axis 22. In other embodiments, the curl direction 79 is directed partially or entirely outward away from the central axis 22, also referred to as the end portion 56 curling beyond vertical. In certain embodiments and shown in in FIGS. 8-12, the curl direction 79 is directed at an angle both rearward and radially outward away from the central axis 22.

Figure 6:
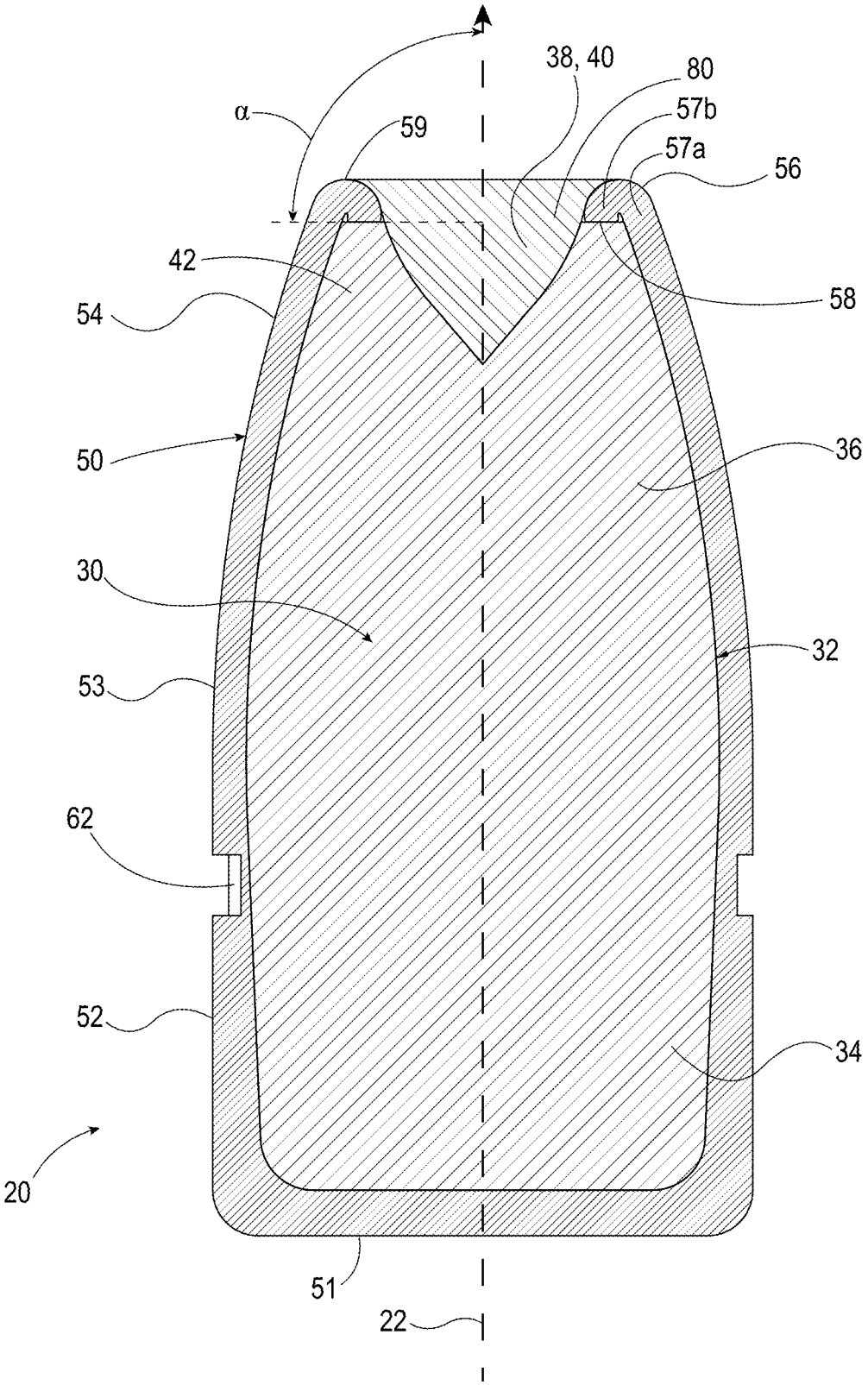
FIG. 6 is a top perspective view of an example bullet in accord with embodiments of the present disclosure in cross-section taken along the line A-A in FIG. 3.
Figure 7:
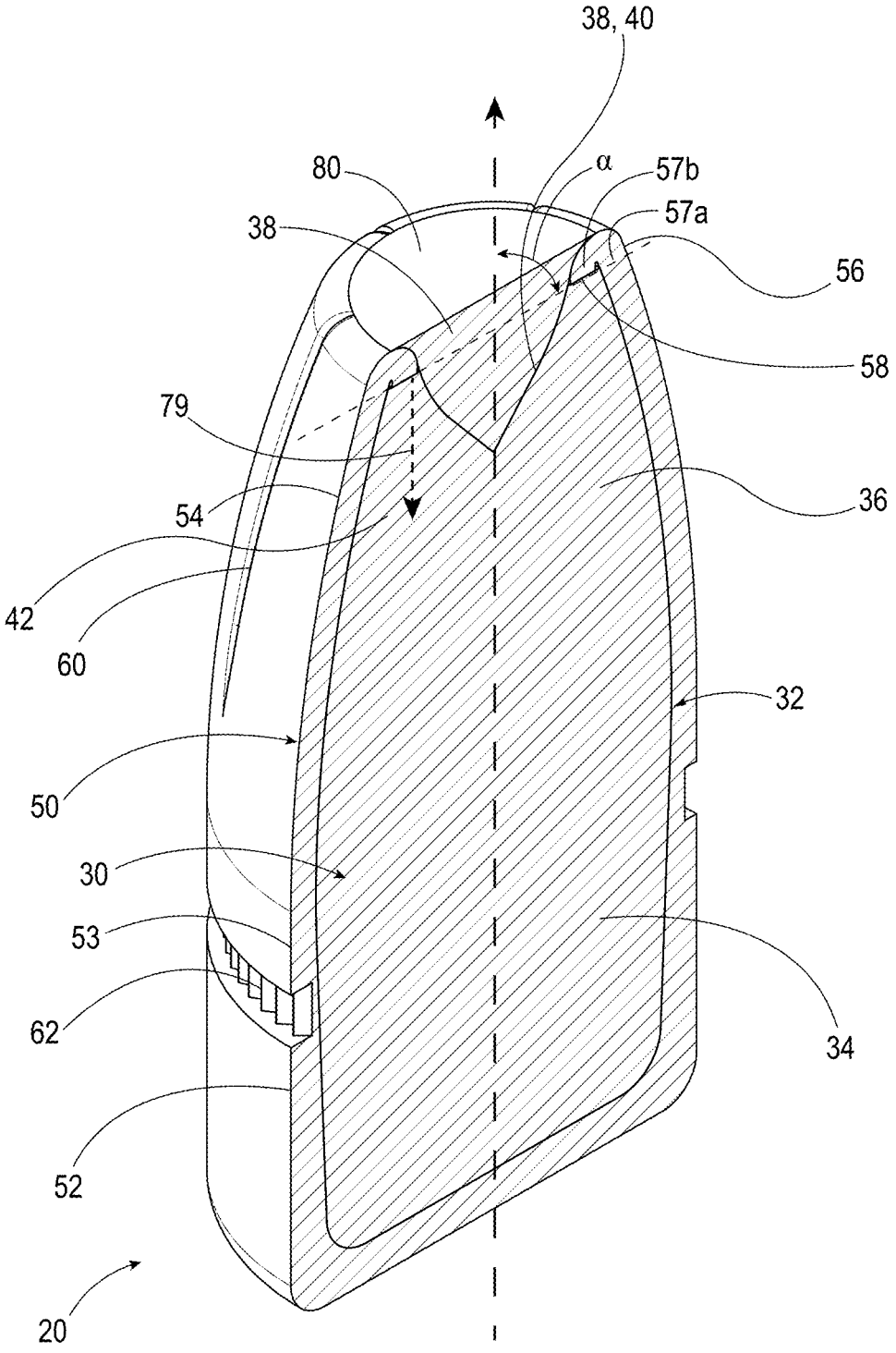
FIG. 7 is a side elevation view of the bullet in FIG. 6.
Figure 8:
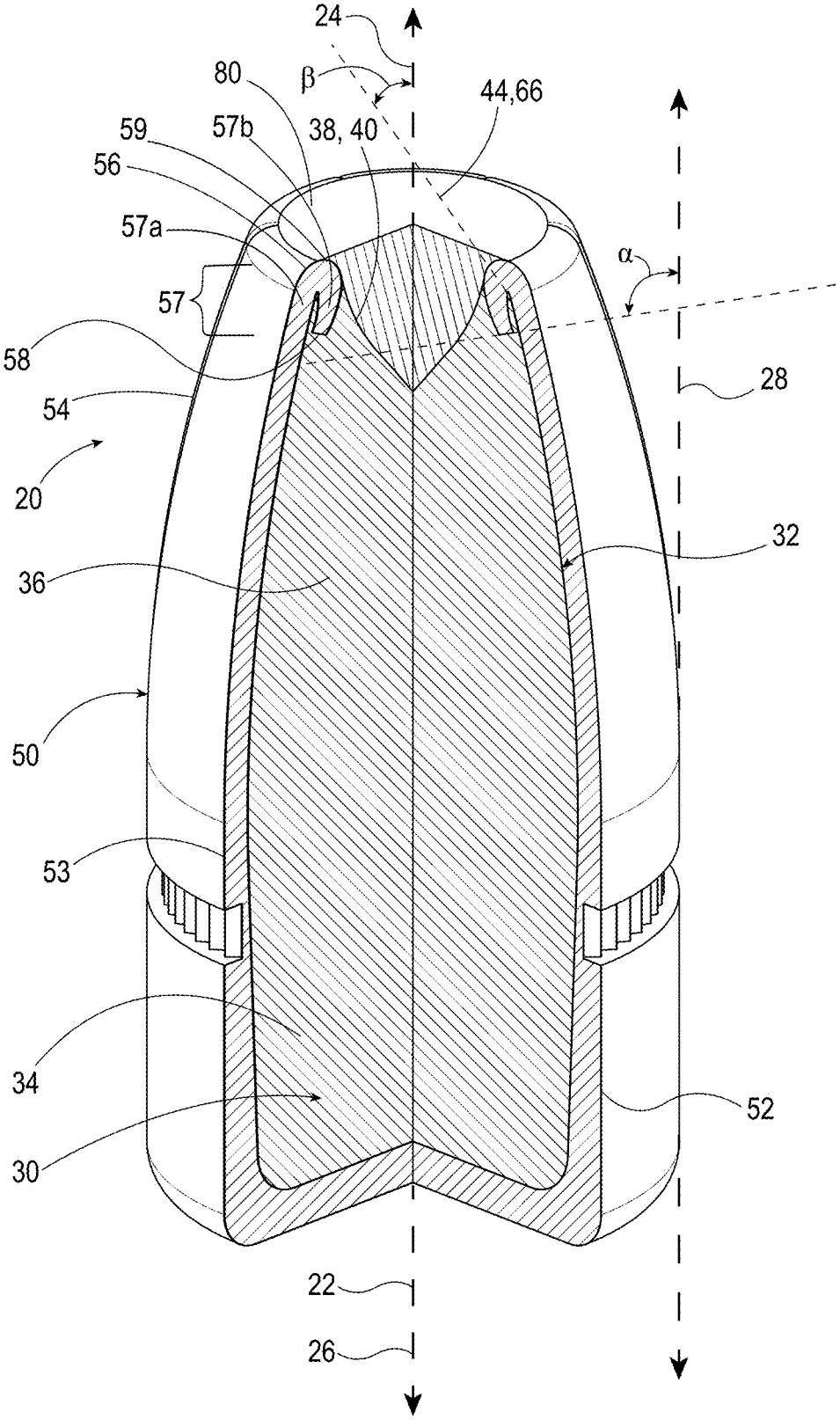
FIG. 8 is a top perspective view of another example bullet in accord with embodiments of the present disclosure with a portion removed along the line B-B in FIG. 1.
Figure 9:
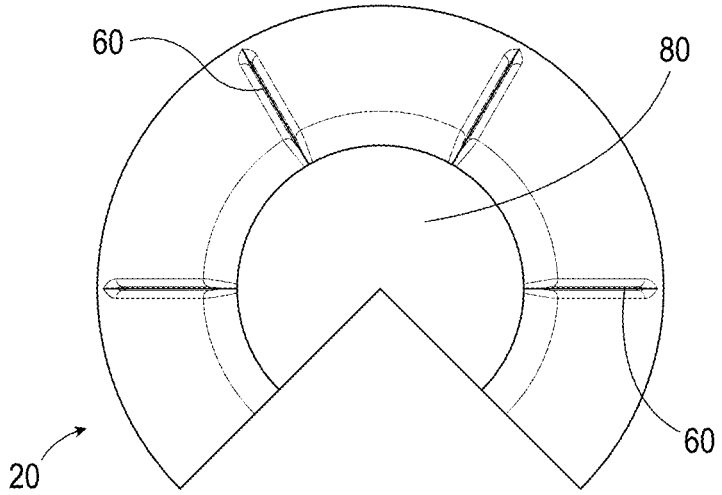
FIG. 9 is a top view of the bullet in FIG. 8.
Figure 10:
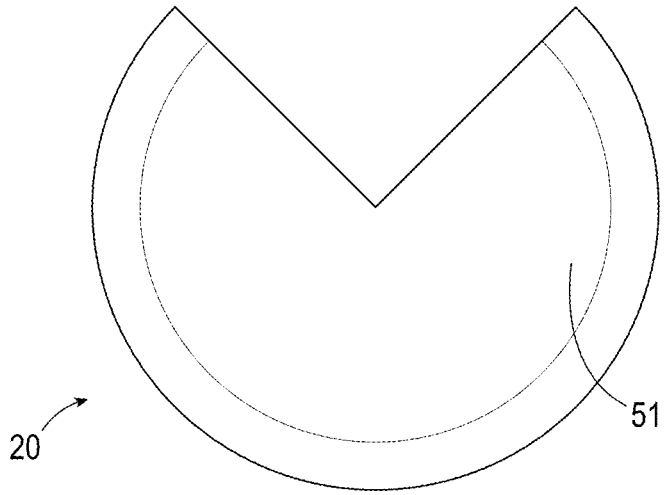
FIG. 10 is a bottom view of the bullet in FIG. 8.
Figure 11:
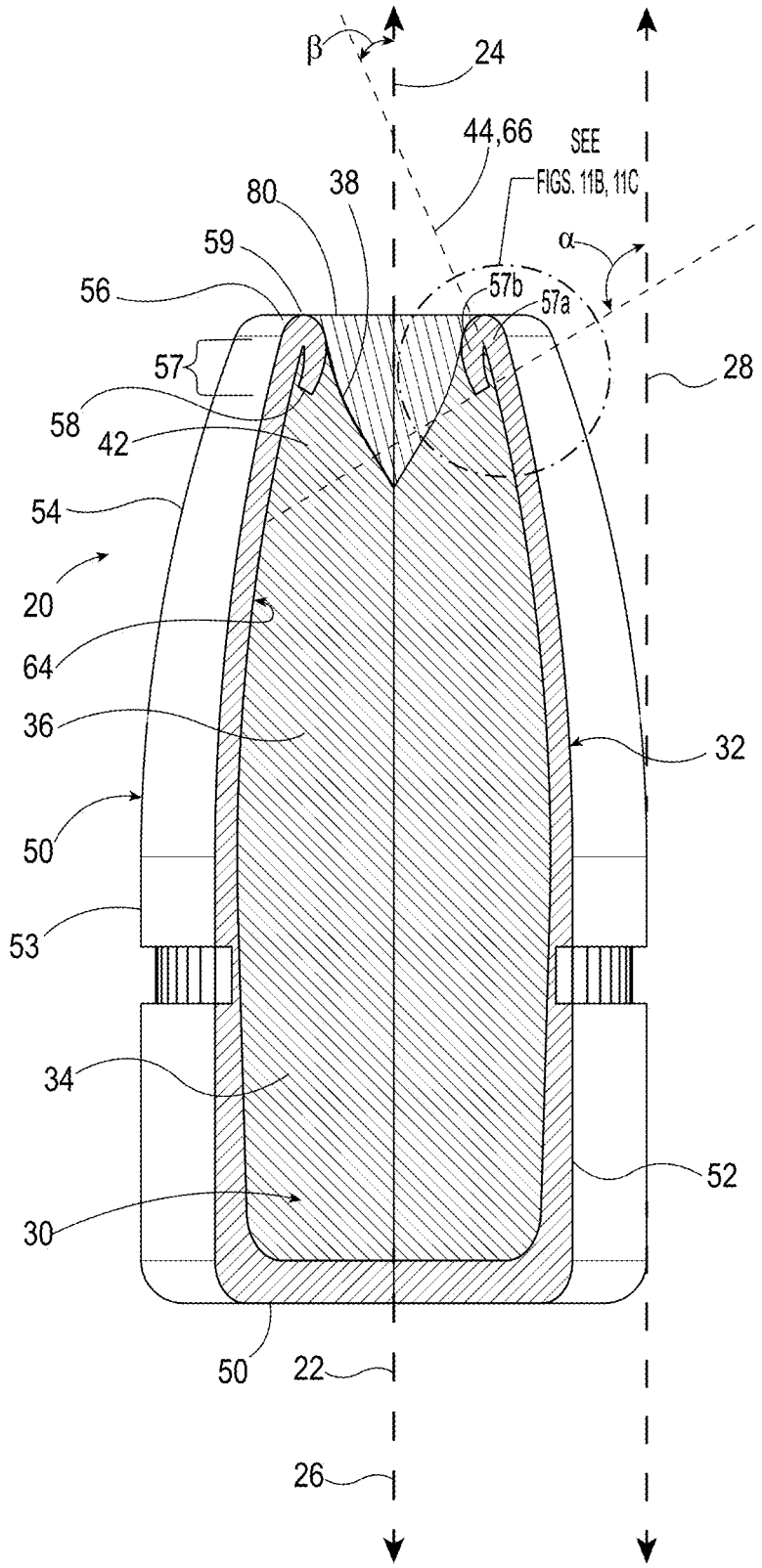
FIG. 11 is a side elevation view of the bullet in FIG. 8.
Figure 11B:
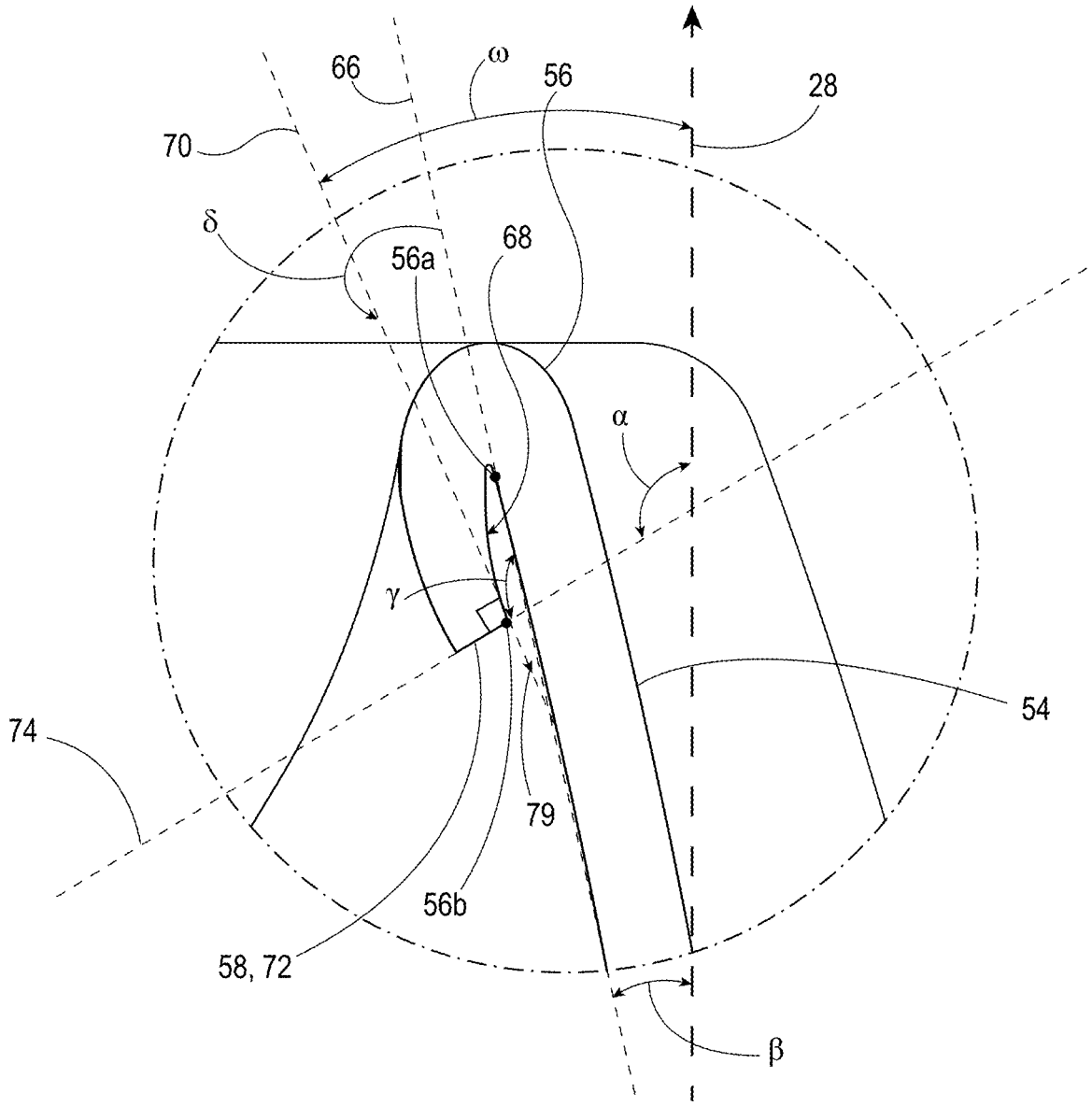
FIG. 11B is a partial zoomed view of an embodiment of the bullet of FIG. 11.

As shown in FIGS. 6-7, in embodiments, the terminal face angle α is about 90 degrees. As shown in FIGS. 11 and 11B, in embodiments, the terminal face angle α is greater than 90 degrees to an angle of about 135 degrees. In some embodiments, regardless of the shape of the terminal face 58, the terminal face angle α is defined by a face reference line 74 or 174 extending perpendicular to the curl direction 79 at an endpoint 56B of the end portion, resulting in the terminal face angle α being about 90 degrees to about 135 degrees. Generally speaking, the terminal face angle α may be at least 90 degrees to produce extra thickness in the jacket 50 at the end portion 56 and the double walled region 57. In other embodiments, the terminal face angle α may be at least 45 degrees, at least 60 degrees, or at least 75 degrees. As discussed below, in embodiments the jacket 50 may not have a clearly defined terminal face 58, in which case the terminal face angle α and the curl direction 79 may be defined relative to another reference line such as a terminal reference line 74 or 174 that crosses the jacket perpendicular to a midline 176 (FIG. 11C) at an endpoint 56B or 156B where the curled shape and/or radial thickness change substantially, i.e., increase, decrease, or change shape from an otherwise generally-consistent or consistently-tapering arrangement.

Variations are contemplated for the arrangement of curled end portion 56 and the resulting curl direction 79 and terminal face angle α. In embodiments, the terminal face angle α is at least 45 degrees from the reference axis 28, at least 60 degrees, or at least 75 degrees. As shown in the embodiments of FIGS. 6-11, the terminal face angle α is at least about 90 degrees, or about 90 degrees to about 135 degrees. In various embodiments, the terminal face is oriented at a terminal face angle α of about 60 to about 270 degrees, about 60 to about 180 degrees, about 90 to about 270 degrees, about 90 to about 225 degrees, or about 90 to about 180 degrees.

In reference to FIG. 11B, the curled shape of the end portion 56 of the jacket 50 may be defined by the changed orientation of the surfaces of constituent parts. In embodiments, the ogive portion 54 of the jacket comprises a radially inner surface 64, the ogive portion comprising a departure angle β defined by a departure orientation tangent 66 of the inner surface 64 relative to the reference axis 28, the departure orientation tangent defined at a starting point 56A on the inner surface 64 where the end portion 56 begins curling in departure from the ogive shape. An inner surface 68 of the end portion 56 curls inwardly to define a curl tangent 70 at a terminus 72 of the end portion, the curl tangent defining the curl direction 79. A terminal reference line 74 is defined perpendicular to the curl tangent 70 at the terminus 72 and is oriented at an angle γ from the departure orientation tangent 66. The inner surface 68 of the jacket rotates from the starting point 56A to the ending point 56B about an arc angle δ from the departure orientation tangent 66 to the terminal tangent 74.

The curl tangent 70 is oriented at a curl angle ω relative to the reference axis 28 such that embodiments providing an axially-extending curl tangent 70 comprise a curl angle ω of 0 degrees and comprise the curl direction 79 being directed directly rearward. In embodiments, the curl angle ω may be about −45 to about 90 degrees, about −30 to about 90 degrees, about −15 to about 90 degrees, about 0 to about 90 degrees, about 0 to about 60 degrees. As such, in the embodiment of FIGS. 6-7 the curl tangent 70 (not shown) would be substantially vertical and parallel to the reference axis 28 and the curl angle ω would be 0 degrees. In the embodiments illustrated in FIGS. 6-11, the curl angle ω is about 0 to about 45 degrees relative to the reference axis 28 (and likewise relative to the central axis 22) and the curl direction 79 is substantially rearward or rearward and radially outward. The orientation of the angle γ, the arc angle δ, and curl angle ω that are defined by the curl tangent may vary in the same manner as the variations in the terminal angle α discussed above depending on the amount of curl in the end portion 56.

Figure 11C:
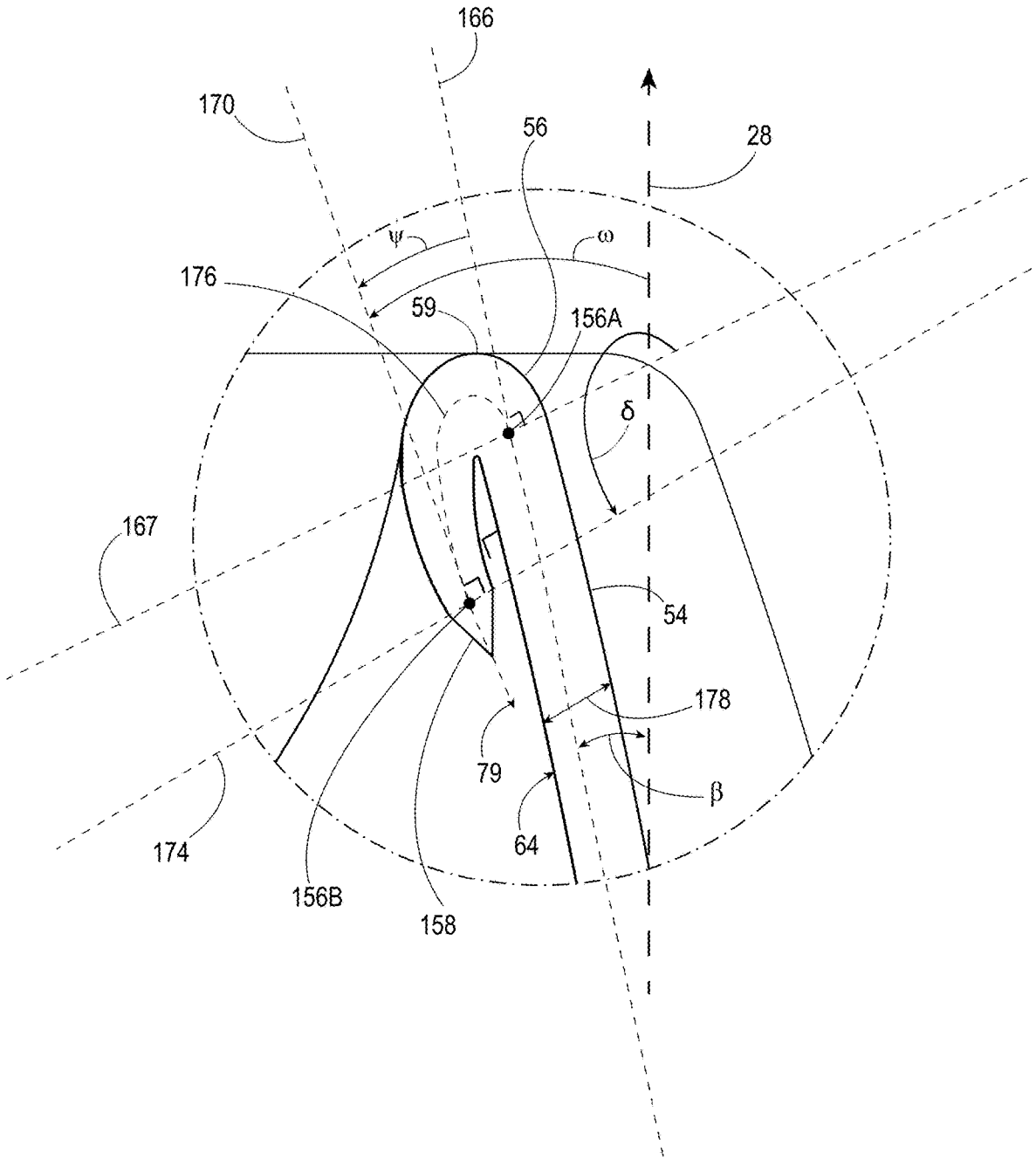
FIG. 11C is a partial zoomed view of another embodiment of the bullet of FIG. 11.

In reference to FIG. 11C, the curled shape of the end portion 56 of the jacket 50 may be defined in reference to the orientation of a midline 176 of the jacket 50. In embodiments, the jacket 50 comprises a midline 176 extending longitudinally at the middle of the radial thickness 178 of the jacket 50. In the end portion 56, the midline 176 rotates from a starting point 156A where the curl shape departs from the ogive shape to an endpoint 156B. The endpoint is defined where the radial thickness 178 changes substantially, i.e., increases, decreases, or changes shape from an otherwise generally consistent thickness or consistently tapering thickness, or for example when the endpoint 156 simply ends and there is no further radial thickness 178. A departure orientation reference line 166 is a tangent of the midline 176 at the starting point 156A. A curl reference line 170 is a tangent of the midline 176 at the endpoint 156B, defining the final orientation of the midline and defining the curl direction 79. A departure face reference line 167 is defined through the starting point 156A and perpendicular to the midline 176, and similarly a terminal face reference line 174 is defined through the endpoint 156B and perpendicular to the midline 176.

The midline 176 of the jacket rotates from the starting point 156A to the ending point 156B about an arc angle δ from the departure face reference line 167 to the terminal face reference line 174. The departure orientation reference line 166 at the starting point 156A (and end of the ogive portion 54) comprises a departure angle β defined by a departure orientation of the departure orientation reference line 166 of the midline 176 relative to the reference axis 28, and thus central axis 22. The curl reference line 170 extends at an angle ψ relative to the departure orientation reference line 166 and therefore the angle ψ varies depending on both the ogive shape and the curl direction 79. In some embodiments the curl reference line 170 and the departure orientation reference line 166 are parallel and the angle ψ is 0 degrees. In certain embodiments, the angle ψ is greater than 0 degrees; in other words, the curl direction 79 is oriented at least partially radially outward and the end portion 56 curls beyond vertical. In embodiments with a minimal ogive (e.g., departure orientation reference line 166 being about 15 to about 30 degrees or less counterclockwise from reference axis 28) and the curl direction 79 being substantially rearward, the angle ψ is about −15 to about −30 degrees. In embodiments with a minimal ogive and the curl direction 79 being substantially radially outward, the angle ψ is about 60 to about 75 degrees. In various embodiments, the angle ψ may extend from about −45 degrees to about 90 degrees.

Similar to the embodiment of FIG. 11B, the curl direction 79 in FIG. 11C as defined by the midline 176 may vary. In embodiments, the curl direction 79 is one of substantially the rearward direction 26 (as in FIGS. 6-7) or directed rearward and angled inward toward the central axis 22. In other embodiments, the curl direction 79 is directed partially or entirely outward away from the central axis 22, also referred to as the end portion 56 curling beyond vertical. In certain embodiments and shown in in FIGS. 8-12, the curl direction 79 is directed at an angle both rearward and radially outward away from the central axis 22.

The curl reference line 170 is oriented at a curl angle ω relative to the reference axis 28 such that embodiments having a vertical curl reference line provide a curl angle ω of 0 degrees. In embodiments, the curl angle ω may be about −45 to about 90 degrees, about −30 to about 90 degrees, about −15 to about 90 degrees, about 0 to about 90 degrees, about 0 to about 60 degrees. As such, in the embodiment of FIGS. 6-7 the curl reference line 170 (not shown) would be substantially vertical and parallel to the reference axis 28 and therefore the curl angle ω would be 0 degrees. In the embodiments illustrated in FIGS. 6-11, the curl angle ω is about 0 to about 45 degrees relative to the reference axis (and likewise relative to the central axis 22) and the curl direction 79 is substantially rearward or rearward and radially outward. The orientation of the arc angle δ, the angle ψ, and the curl angle ω that are defined by the curl reference line 170 and/or the terminal face reference line 174 may vary in the same manner as the variations in the terminal angle α discussed above and reflecting the amount of curl in the end portion 56.

The definition of the endpoint 56B, 156B may vary along the end portion 56 (i.e., along the midline 176 and/or along the radially inner face 68) and generally the endpoint may be selected anywhere on the distal portion 57B beyond the forward tip 59 of the jacket 50. Likewise the aforementioned jacket material beyond the endpoint 56B, 156B (e.g., substantial change in radial thickness) could take various forms, such as a thickness decrease by tapering or angling or a thickness increase by flattening or mushrooming. In other words, instead of a flat end face 58 as in other embodiments, an end portion 158 may be cut, pinched, rounded, S-curved, crimped, or otherwise deformed in any direction(s). It will be appreciated that there may be imperfections or irregular shapes in the curling end portion 56 due to the limitations of the materials and tooling, for example due to material buckling as it folds. Likewise, the jacket 50 may have a substantially consistent tapering thickness along the end portion 56, along the ogive portion 54, or along the entire length of the bullet. Accordingly, the fold of the end portion 56 comprises an amount of inward curl defined from starting point 156A to the selected endpoint 156B.

Figure 13:
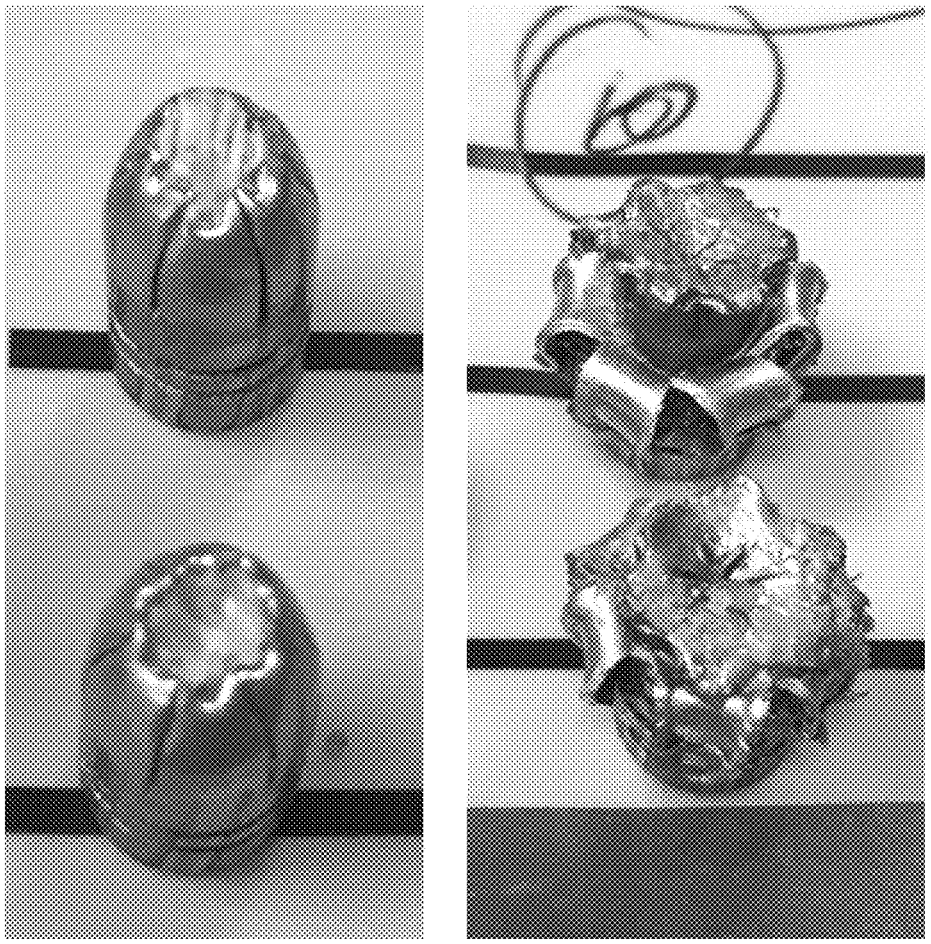
FIG. 13 is a top perspective view of performance testing of bullets in accord with embodiments of the present disclosure contrasted with similar size bullets.
Figure 14:
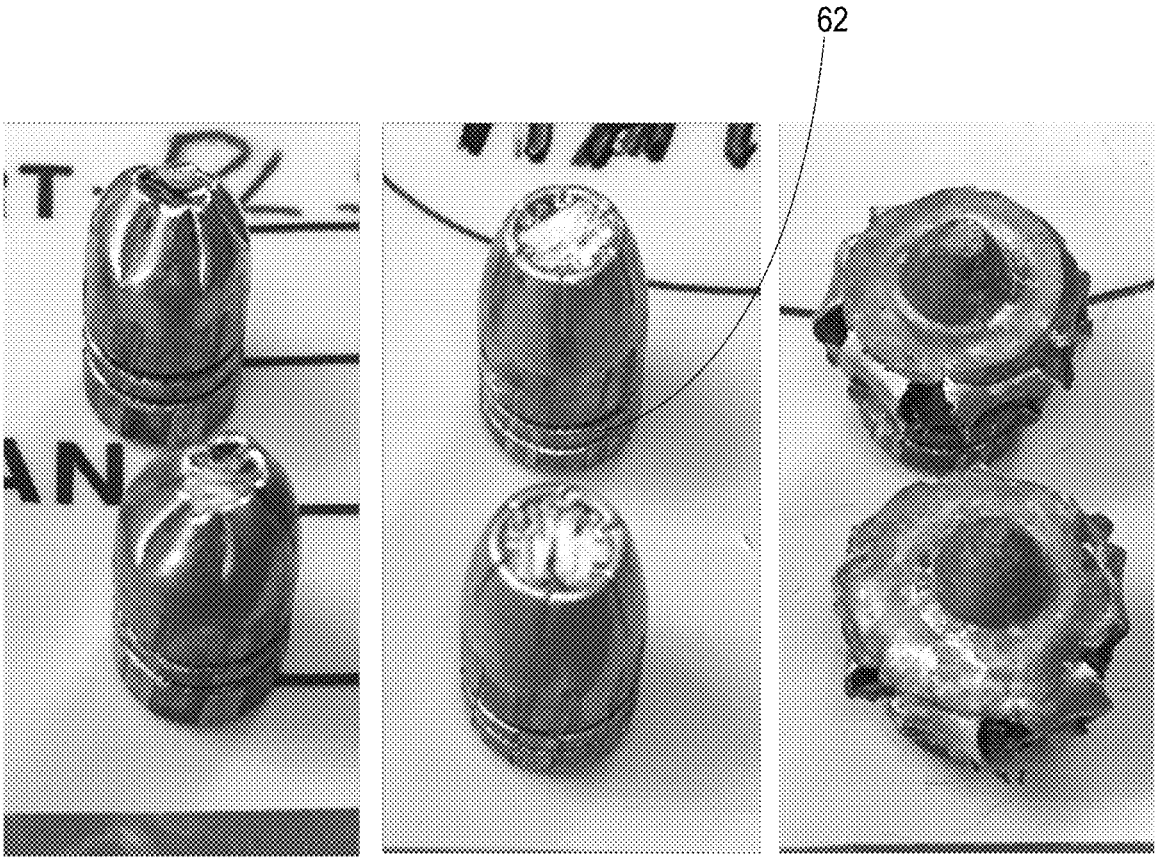
FIG. 14 is a top perspective view of performance testing of bullets in accord with embodiments of the present disclosure contrasted with similar size bullets.

FIGS. 13-14 depict performance testing of bullets applicable to the present disclosure labeled "folded mouth." The bullets were subjected to tests where the bullets were fired through a sheet of plywood and into ballistics gel. The "Standard HST" bullet plugged with a chunk of plywood, and the force of passing through the plywood caused the mouth of the Standard HST bullet to collapse. The Standard HST bullet failed to petal when striking the ballistic gel. The "Folded Mouth HST" bullet contained a double wall at the terminal face of the jacket as described herein, but did not include the deformable material 80. This example passed through the plywood and petaled in a satisfactory manner in the ballistic gel. The examples labeled "Standard HS Deep" and "Folded Mouth HS Deep" failed in a similar manner to the "Standard HST" bullet insofar as they did not petal; the Folded Mouth HS Deep demonstrates improved strength through structural integrity but its open cavity experienced plugging upon impact with a hard barrier. However, the "Folded Mouth HS Deep w/ elastomer" performed satisfactorily in ballistic gel after passing through the plywood. This embodiment included a thermoplastic elastomer as the deformable material 80 filling the cavity 38 of the hollow point bullet 20. The folded mouth defined by the end portion 56 provides increased strength that resists inward collapse when striking plywood or another hard barrier while the remainder of the jacket is sufficiently weak to tear and petal in softer materials.

Figure 15A:
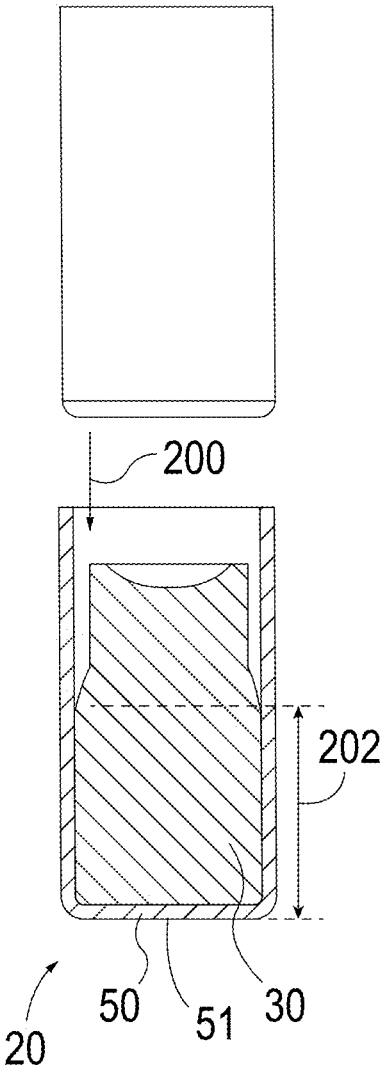
FIGS. 15A-15F are a partial series of manufacturing steps, each step being shown in both a side elevation (top) and a side cross-sectional view (bottom), in accord with an embodiment of the present disclosure.
Figure 15B:
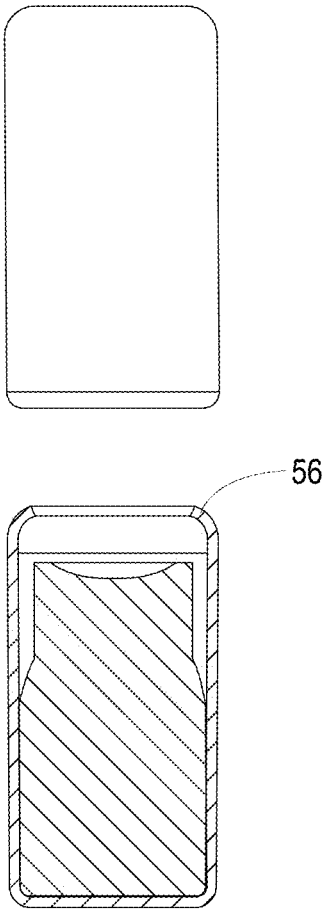
Figure 15C:
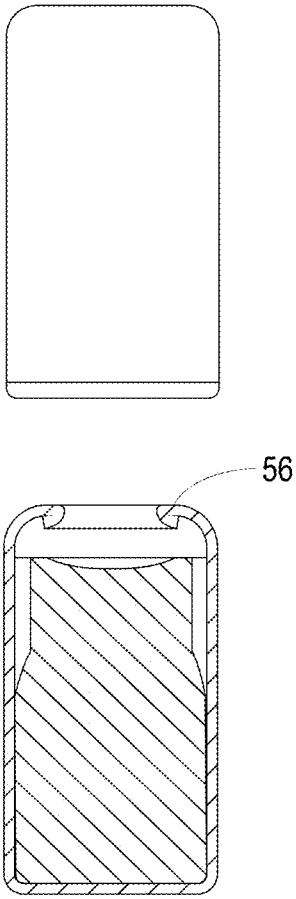
Figure 15D:
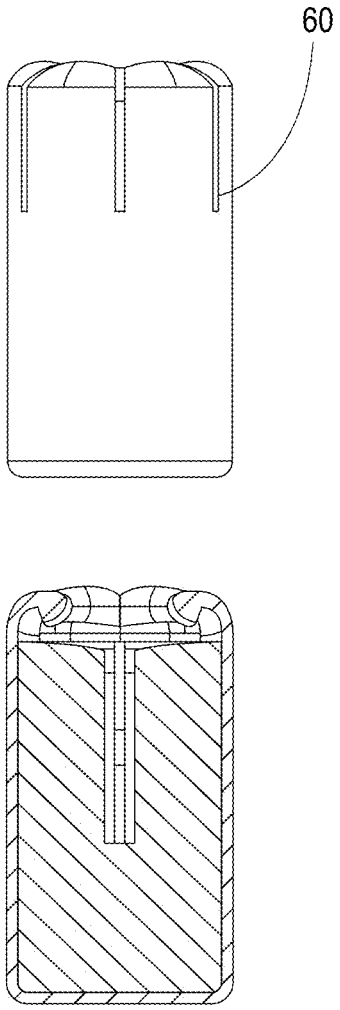
Figure 15E:
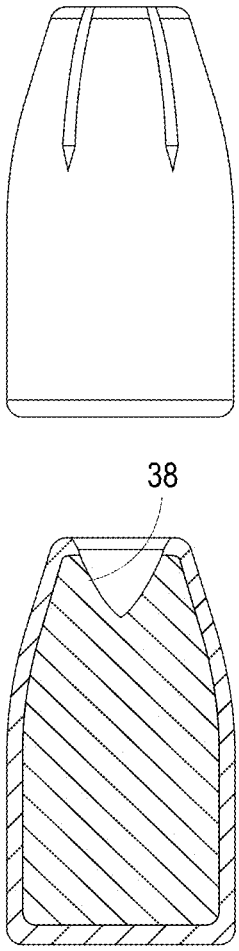
Figure 15F:
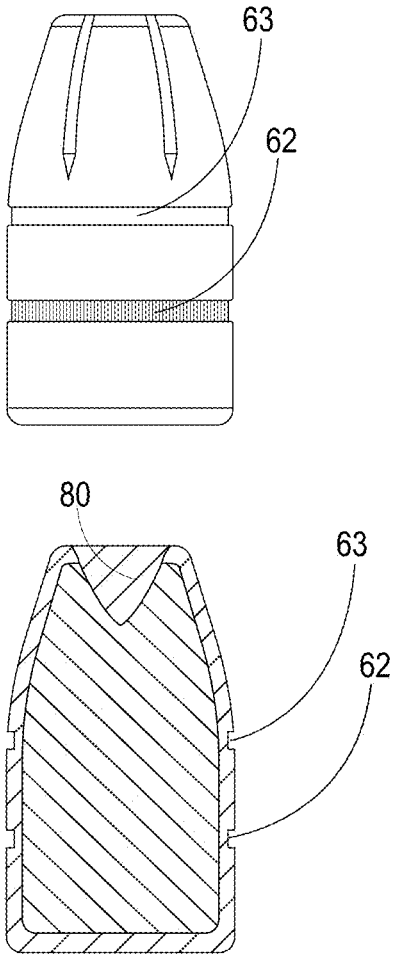

FIGS. 15A-F depicts a partial set of manufacturing steps in both side elevation view and cross-sectional view, the steps being applicable to embodiments of the present disclosure that result in a folded mouth bullet 20 that is also "partially bonded." In embodiments, before the step shown in FIG. 15A, the core 30 and the jacket 50 are bonded together by a mechanical process, electrochemical process, and/or by other known processes. At this point, the bullet 20 has no neck, ogive shape, hollow point cavity 38, or deformable material 80. The core 30 and jacket 50 are substantially cylindrical. At of the step shown in FIG. 15A, a punch is inserted in the direction indicated 200 to separate and break bonds between the core 30 and the jacket 50 in a forward region of the bullet, resulting in a bullet that is partially bonded. Subsequently, the bullet 20 is formed into its final shape by working the jacket 50. In the steps shown in FIGS. 15B-C, the folded end section 56 is formed in the jacket 50. In the step shown in FIG. 15D, the skives 60 are formed. In the step shown in FIG. 15E, the ogive shape and the cavity 38 are formed. In the step shown in FIG. 15F, the deformable material 80 is added along with the cannelures 62, 63, one or more of which in embodiments may not indent the core 30. In embodiments, certain steps of FIGS. 15A-F may be omitted or modified; for example, the step shown in FIG. 15A for partial bonding may be performed with other bullets regardless of whether the steps of FIGS. 15B-F are performed and the steps shown in FIGS. 15B-E forming the curled end portion 56 may be omitted or performed independently of other steps. The step shown in FIG. 15F may be omitted, performed in part, or performed in whole.

Figure 16A:
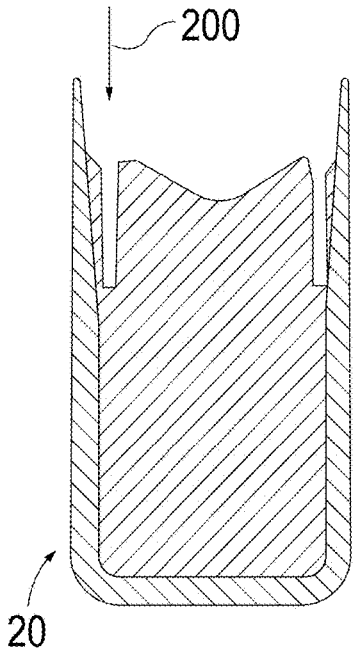
FIGS. 16A-16F are a partial series of manufacturing steps, each step being shown in a side cross-sectional view, in accord with another embodiment of the present disclosure.
Figure 16B:
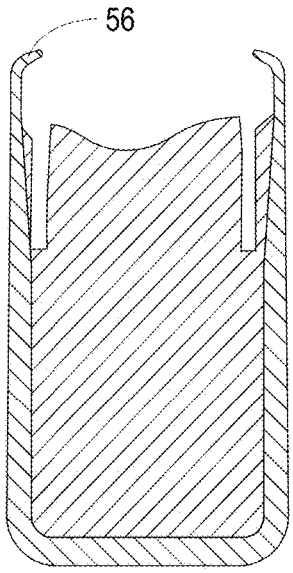
Figure 16C:
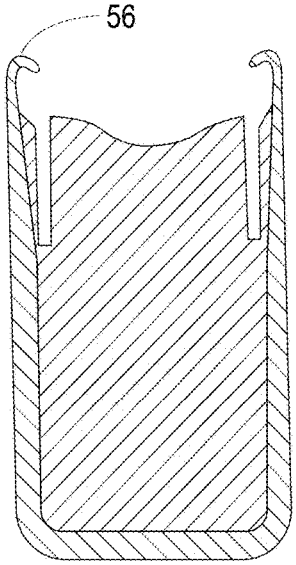
Figure 16D:
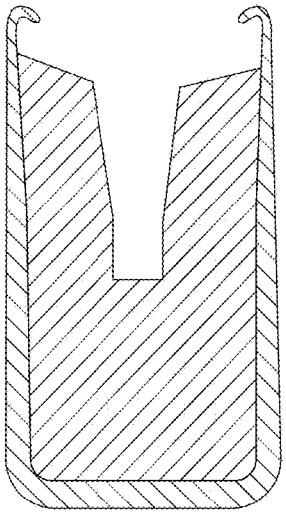
Figure 16E:
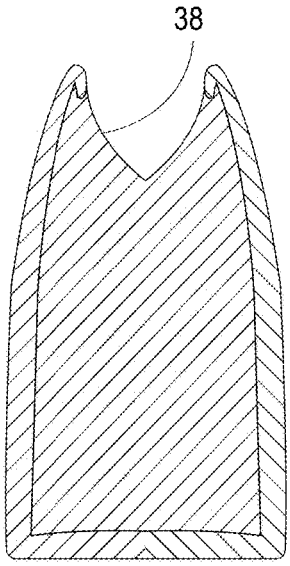
Figure 16F:
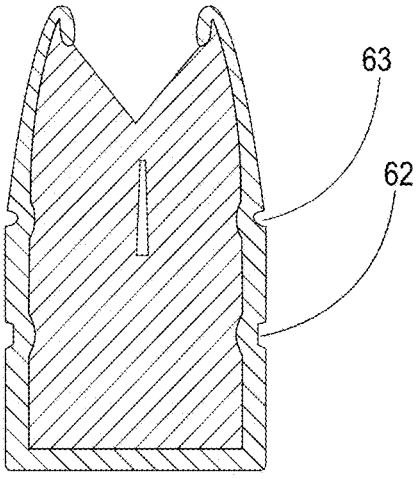

FIGS. 16A-F depict another embodiment of a partial set of manufacturing steps in cross-sectional view applicable to embodiments of the present disclosure that result in a folded mouth bullet 20 that is also partially bonded. The step shown in FIG. 16A is substantially similar to the step shown in FIG. 15A for removing the bond with a punch, and in embodiments the step shown in FIG. 16A may be preceded by a bonding process between the core 30 and the jacket 50. The steps shown in FIGS. 16B-C are substantially similar to the steps shown in FIGS. 15B-C beginning to form the folded mouth in the end portion 56 at the forward end of the jacket. Likewise The step shown in FIG. 16D forms the cavity 38. The steps shown in FIG. 16E form the ogive shape of the bullet, finalize the shape of the cavity, and finalize the curled end portions of the jacket forming the folded mouth. The step shown in FIG. 16F adds additional working to the jacket to form the shear groove 63 and the cannelure 62, both of which in this embodiment also form indentations in the core 30. In embodiments, certain steps of FIGS. 16A-F may be omitted or modified; for example, the step shown in FIG. 16A for partial bonding may be performed with other bullets regardless of whether the steps of FIGS. 16B-F are performed and the steps shown in FIGS. 16B-E forming the curled end portion 56 may be omitted or performed independently of other steps. The step shown in FIG. 16F may be omitted, performed in part, or performed in whole. In further reference to processes with the partial bonding step shown in FIG. 15A and FIG. 16A, the punch is inserted in direction 200 from the open forward end to a depth 202 measured from the rear end 51 of the bullet, resulting in a separation or incidental non-bonded contact between the core 30 and jacket 50 down to depth 202. After manufacturing is complete, the lack of a bond forward of the depth 202 is undetectable in the final bullet by visual inspection from the outside or even after a cross-sectional cut. The remaining rearward portions of the core 30 and jacket 50 remain bonded.

In some embodiments, the depth 202 of separation corresponds to the extent of the ogive shape, such as the ogive portion 54 of the jacket 50. In embodiments, the depth 202 of separation is adjacent to, slightly forward, or slightly rearward of the location of a cannelure 62, 63 (e.g., the forward cannelure 63 as shown in FIGS. 12, 14, 15F, and 16F) or another weakening feature. In embodiments, the depth 202 is adjacent to or slightly deeper than the depth of the skives 60 or another weakening feature. In certain embodiments, the depth 202 is a percentage of the overall length 90 of the bullet 20 from the rear end 51 to the forward tip 59, and in embodiments the depth 202 may be about 50-75% or about 30%-90% of the overall length 90. In other embodiments, the depth 202 as a percentage of the overall length 90 could vary to be 10%, 15%, 20%, 25%, 30%, 35%, 40%, 45%, 50%, 55%, 60%, 65%, 70%, 75%, 80%, 85%, or 90%, or any ranges or sub-ranges therebetween. Referring to FIG. 12, the bullet 20 comprises an overall length 90 that in certain embodiments is about 0.651 inches and the depth 202 is about 0.405-0.415 inches or about 0.390-0.430 inches from the rear end 51. Because the partial bonding bullet's separation is weaker than an equivalent bonded bullet, the separation contributes to impact performance and can enhance the functionality of the skives 60 and cannelure 62.

Testing has shown that the partially bonded bullet 20 performs well in glass tests, in which the jacket 50 completely shears and separates at or in front of the forward cannelure 63 while the remaining bullet is less inhibited by glass shards. In other words, after the bullet strikes glass, the forward portion of the jacket 50 petals and peels back along the skives 60. When the petals reach the forward cannelure 63, the petals shear and separate from the bullet. This shearing and separation prevents overexpansion of the petals further rearward along the jacket 50, which would possibly otherwise inhibit subsequent flight, impact, and penetration. Due to the non-bonded forward area of the bullet 20, there is significantly less force required for the jacket to initially petal and also less force required to shear and separate. In certain embodiments, the remaining forward portion of the bullet comprises the forward portion of the core 30, which substantially maintains an ogive shape, allowing the bullet to maintain a high velocity and sufficient penetration in a ballistic material. In other embodiments, portions of the forward core separate with the petals.

Moreover, testing has shown that the partially bonded bullet 20 performs well in sheet steel tests, in which the partially bonded bullet rivets and collapses inwardly instead of petaling outwardly. In these embodiments, the bullet may expand at one of the cannelure 62, 63 but not at the mouth or hollow point of the bullet. This may be a result of the forward portion of the bullet or core being forced rearward, causing expansion rearward of the tip. Therefore, expansion is still achieved even though the bullet mouth may be obstructed by metal.

It will be appreciated that the separation step of FIGS. 15A and 16A is also applicable to embodiments of bullets that do not have a folded mouth. Likewise, certain embodiments of the folded mouth bullet of the present disclosure omit this separation step and are fully bonded.

The bullet of the present disclosure is applicable to a variety of cartridges and firearms. Certain embodiments herein are specifically addressed to ammunition for handguns issued to law enforcement officers including 9 mm, 0.40 cal, and 0.45 cal ammunition. In some embodiments, the cartridge has a size range from 9 mm to 0.50 caliber. In embodiments, the core may be lead-free or lead. In embodiments, the bullet 20 may be substantially cylindrical and not have an ogive shape (i.e., omit the ogive portion 54 of the jacket 50). The present disclosure may also be applicable to centerfire as well as rimfire cartridges, as well as various types of firearms including handguns, rifles, semiautomatics, automatics, combinations thereof, and the like. Applicable rifles may include match, sporting, and shotgun styles.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A method of manufacturing a bullet, comprising:
providing a jacket with an open forward end;
inserting a core into the jacket;
partially bonding the jacket and the core with an unbonded region forward of a bonded region;
curling the open forward end of the jacket radially inwardly to form a double walled region of the jacket;
forming a forward-facing cavity in the core; and
forming an ogive shape in a forward portion of the bullet.

2. The method of claim 1, wherein the partially bonding step comprises separating the jacket from the core from the forward end to a depth, wherein the depth is not an entire length of the core.

3. The method of claim 2, wherein the separating is performed by a punch.

4. The method of claim 1, wherein the partially bonding step comprises:
applying a barrier to one or more of a forward portion of the core and a forward portion of the jacket, the barrier not applied to rearward portions of the jacket or core, and
bonding rearward portions of the jacket and core.

5. The method of claim 1, wherein the unbonded region extends to a depth measured from a rear of the bullet, the depth being about 50%-75% of an overall length of the bullet.

6. The method of claim 1, further comprising at least one of: forming a skive in the jacket extending approximately to a depth, and forming a shear groove in the jacket approximately at the depth.

7. The method of claim 1, further comprising insetting a cannelure in the jacket.

8. The method of claim 7, further insetting the cannelure in the jacket comprises forming an indentation in the core at the cannelure.

9. A method of manufacturing a bullet, comprising:
providing a jacket with an open forward end;
inserting a core into the jacket;
bonding the jacket and the core;
unbonding a forward region of the core;
curling the open forward end of the jacket radially inwardly to form a double walled region of the jacket; and
forming a converging shape in a forward portion of the bullet including the double walled region.

10. The method of claim 9, further comprising forming a forward-facing cavity in the core.

11. The method of claim 9, wherein the providing an unbonded region comprises separating the jacket from the core to a depth after bonding the jacket and core, thereby defining the unbonded forward region of the core.

12. The method of claim 11, wherein the separating the jacket from the core extends to a depth measured from a rear of the bullet, the depth being about 50%-75% of an overall length of the bullet.

13. The method of claim 11, wherein the separating the jacket from the core comprises utilizing a punch.

14. The method of claim 11, further comprising skiving the jacket.

15. The method of claim 9, wherein unbonding the forward region of the core, comprises unbonding the forward region of the core from at least a portion of a radially inner surface of the jacket.

16. A method of manufacturing a bullet, comprising:
providing a jacket with an open forward end;
inserting a core into the jacket;
providing a partially bonding of the jacket to the core with an unbonded region forward of a bonded region;
forming a forward-facing cavity in the core; p1 curling the open forward end of the jacket radially inwardly to form a double walled region of the jacket; and
forming a converging shape in a forward portion of the bullet including the double walled region.

17. The method of claim 16, wherein the partial bonding of the jacket to the core comprises a mechanical or electrochemical process bonding an entire length of the core to the jacket and mechanically separating the jacket from the core after the bonding the entire length.

18. The method of claim 17, wherein the mechanical separating is by punching.

19. The method of claim 18, further comprising skiving the jacket.

20. The method of claim 19, further comprising insetting a cannelure into the jacket.

21. The method of claim 16, wherein the unbound region is directly adjacent to at least a portion of a radially inner surface of the jacket.

* * * * *